US007385557B2

(12) United States Patent
Kim

(10) Patent No.: US 7,385,557 B2
(45) Date of Patent: Jun. 10, 2008

(54) PIFA DEVICE FOR PROVIDING OPTIMIZED FREQUENCY CHARACTERISTICS IN A MULTI-FREQUENCY ENVIRONMENT AND METHOD FOR CONTROLLING THE SAME

(75) Inventor: Min-Seok Kim, Seoul (KR)

(73) Assignee: Samsung Electronics Co., Ltd (KR)

( * ) Notice: Subject to any disclaimer, the term of this patent is extended or adjusted under 35 U.S.C. 154(b) by 196 days.

(21) Appl. No.: 11/296,794

(22) Filed: Dec. 7, 2005

(65) Prior Publication Data

US 2006/0181465 A1 Aug. 17, 2006

(30) Foreign Application Priority Data

Feb. 17, 2005 (KR) ..... 10-2005-0013138

(51) Int. Cl.
*H01Q 1/24* (2006.01)

(52) U.S. Cl. ..... 343/702; 343/700 MS; 343/828; 343/846; 343/853; 343/895

(58) Field of Classification Search ..... 343/700 MS, 343/702, 876, 846, 725, 742, 770, 828, 853, 343/895

See application file for complete search history.

(56) References Cited

U.S. PATENT DOCUMENTS

| | | | | |
|---|---|---|---|---|
| 5,138,289 | A | 8/1992 | McGrath | |
| 6,392,610 | B1 * | 5/2002 | Braun et al. | 343/876 |
| 6,674,411 | B2 * | 1/2004 | Boyle | 343/860 |
| 6,917,790 | B1 * | 7/2005 | Braun et al. | 455/101 |
| 6,954,180 | B1 * | 10/2005 | Braun et al. | 343/702 |
| 6,980,782 | B1 * | 12/2005 | Braun et al. | 455/277.2 |
| 7,027,838 | B2 * | 4/2006 | Zhou et al. | 455/562.1 |
| 7,136,020 | B2 * | 11/2006 | Yamaki | 343/702 |

FOREIGN PATENT DOCUMENTS

| | | |
|---|---|---|
| EP | 0 993 070 | 4/2000 |
| EP | 1 387 435 | 2/2004 |
| GB | 937452 | 10/1959 |
| JP | 04199903 | 7/1992 |
| JP | 08-321716 | 12/1996 |
| JP | 2002-261533 | 9/2002 |
| WO | WO 01/29927 | 4/2001 |
| WO | WO 01/91235 | 11/2001 |

* cited by examiner

*Primary Examiner*—Douglas W. Owens
*Assistant Examiner*—Chuc Tran
(74) *Attorney, Agent, or Firm*—The Farrell Law Firm, PC

(57) ABSTRACT

A Planar Inverted-F Antenna (PIFA) device and a method for controlling the PIFA device that can provide optimized frequency characteristics in a multi-frequency environment. The PIFA device is provided with a plurality of shorting pins located at different distances from a feeding pin and an antenna switch capable of selecting one of the shorting pins, or is provided with an antenna switch capable of moving a shorting pin to a preset position, thereby adjusting a distance between the feeding and shorting points. Antenna frequency characteristics can be optimized according to a frequency band used at the current location, and the antenna frequency characteristics can be optimally maintained in the multi-frequency environment at any time.

15 Claims, 7 Drawing Sheets

PIFA DEVICE FOR PROVIDING OPTIMIZED FREQUENCY CHARACTERISTICS IN A MULTI-FREQUENCY ENVIRONMENT AND METHOD FOR CONTROLLING THE SAME

PRIORITY

This application claims priority under 35 U.S.C. § 119 to an application entitled "PIFA Device for Providing Optimized Frequency Characteristics in a Multi-Frequency Environment and Method for Controlling the Same" filed in the Korean Intellectual Property Office on Feb. 17, 2005 and assigned Ser. No. 2005-13138, the contents of which are incorporated herein by reference.

BACKGROUND OF THE INVENTION

1. Field of the Invention

The present invention generally relates to a mobile communication terminal, and more particularly to a Planar Inverted-F Antenna (PIFA).

2. Description of the Related Art

The current miniaturization trend in mobile communication terminals is being accelerated. According to this miniaturization trend, mobile communication terminals are now being produced with internal antennas that produce smaller overall mobile terminals.

A typical internal antenna is a Planar Inverted-F Antenna (PIFA). FIG. 1 illustrates an exemplary structure of a conventional PIFA. Referring to FIG. 1, the PIFA is provided with a ground plane 102, a patch 100, a feeding pin 104, and a shorting pin 106. Here, the shorting pin 106 can be replaced with a shorting plate. When an electric current is fed to the patch 100 mounted above the finite ground plane 102 through the feeding pin 104, the patch 100 and the ground plane 102 are excited and act as a radiating device. A frequency bandwidth, gain, and resonant frequency of the PIFA depend upon the height, width, and depth of the patch 100 and a distance z between the feeding pin 104 and the shorting pin 106 or the shorting plate.

One advantage of the PIFA is that it can be embedded within a mobile communication terminal. However, there is a drawback in that the PIFA is limited by a space within the mobile communication terminal. In case of the PIFA as described above, antenna frequency characteristics such as a frequency bandwidth, gain, resonant frequency, and so on can vary according to the height, width, and depth of the patch 100 and other factors. Because the PIFA is limited by the space within the mobile communication terminal, the antenna frequency characteristics are also limited by the space within the mobile communication terminal. The mobile communication terminal in which the PIFA is embedded is designed to maximize the frequency characteristics of the PIFA for one specific frequency band.

Currently, various frequency bands are used in regions of the world. For example, in South Korea, cellular and personal communication service (PCS) systems use frequency bands of 800 MHz and 1700 MHz, respectively. In the United States, the cellular and PCS systems use frequency bands of 800 MHz and 1900 MHz, respectively. In China, a frequency band of 2100 MHz is used. In Romania and Russia, the cellular system uses a frequency band of 450 MHz. In Poland and the Ukraine, a frequency band of 850 MHz is used. Accordingly, the PIFA is designed to operate over various frequency bands, so that a user can receive a mobile communication service even when moving to another country.

Structural features of the mobile communication terminal significantly influence the frequency characteristics of the PIFA. For example, the frequency characteristics of an antenna change over different frequency bands and according to a slide or folder structure or an open or close state thereof. Here, the open state is a state in which a folder is open in the folder structure, while the close state is a state in which the folder is closed in the folder structure. The open and close states also exist in the slide-type mobile communication terminal. When the PIFA is designed, elements such as the patch 100, the ground plane 102, the shorting pin 106, and the feeding pin 104 capable of influencing the frequency characteristics are designed such that the antenna frequency characteristics can be optimized for specific structural features and can be minimized for other structural features.

When the user uses the mobile communication terminal in a different frequency band, the influence to the frequency characteristics for the specific structural features can vary with the different frequency band in use. For example, the effect on the frequency characteristics in the open state of the folder may be different between 800-MHz and 450-MHz bands. Accordingly, there is a problem in that the conventional PIFA cannot satisfy multi-frequency characteristics according to the structural features of a specific mobile communication terminal.

SUMMARY OF THE INVENTION

It is, therefore, an object of the present invention to provide a Planar Inverted-F Antenna (PIFA) device and a method for controlling the PIFA device that can satisfy characteristics of various frequencies in a multi-frequency environment in a mobile communication terminal.

The above and other objects of the present invention can be achieved by an apparatus that includes a memory for storing frequency characteristic compensation values mapped on a frequency band basis according to influence of each frequency band in a multi-frequency environment; a Planar Inverted-F Antenna (PIFA) device for varying a distance between feeding and shorting pins; and a controller for performing a control operation such that the distance between the feeding and shorting pins is varied with a specific frequency characteristic compensation value mapped to a specific frequency band.

The above and other objects of the present invention can also be achieved by a method that includes changing a frequency band according to location of a mobile communication terminal; determining if an operating state of the mobile communication terminal requires frequency characteristic compensation for a Planar Inverted-F Antenna (PIFA) in the changed frequency band; loading a frequency characteristic compensation value according to a current operating state if the operating state requires the frequency characteristic compensation; adjusting a distance between feeding and shorting pins according to the loaded frequency characteristic compensation value; determining if the operating state of the mobile communication terminal has ended; and recovering compensated frequency characteristics according to the operating state of the mobile communication terminal if the operating state of the mobile communication terminal has ended.

BRIEF DESCRIPTION OF THE DRAWINGS

The above and other objects and advantages of the present invention will be more clearly understood from the following detailed description taken in conjunction with the accompanying drawings, in which.

DETAILED DESCRIPTION OF THE PREFERRED EMBODIMENTS

Figure 1:
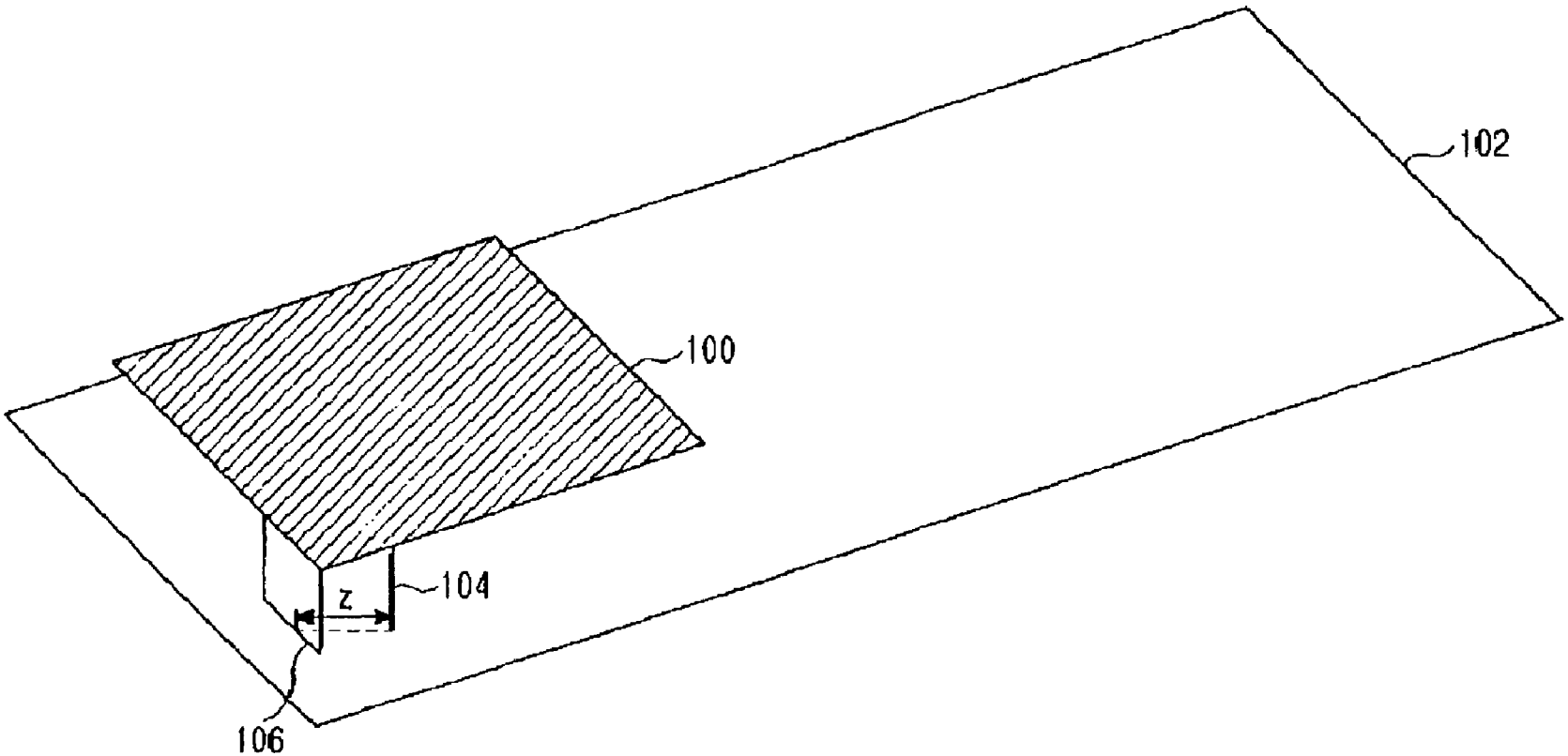
FIG.1 (PRIOR ART)
FIG. 1 illustrates an exemplary structure of a conventional Planar Inverted-F Antenna (PIFA)

Preferred embodiments of the present invention will be described in detail herein below with reference to the accompanying drawings. In the drawings, the same or similar elements are denoted by the same reference numerals even though they are depicted in different drawings. In the following description, detailed descriptions of functions and configurations incorporated herein that are well known to those skilled in the art are omitted for clarity and conciseness.

For a better understanding of the present invention, a basic principle of the present invention will be first described. The present invention can vary a distance between the feeding and shorting pins to adjust to various frequencies in a multi-frequency environment. For this, the present invention includes a plurality of shorting pins or plates located at distances from a feeding pin that can optimize frequency characteristics of an antenna of a mobile communication terminal operating at various frequencies. The present invention includes an antenna switch for selecting optimal pins or plates from the plurality of shorting pins or plates. In an embodiment of the present invention, a controller of the mobile communication terminal controls optimal shorting pins or plates to be selected. When current location information of the mobile communication terminal is input from a user or base station (BS), the optimal shorting pins or plates can be selected on the basis of the input location information. In accordance with an embodiment of the present invention, the mobile communication terminal exploits shorting pins or plates located at distances that can optimize the antenna frequency characteristics on the basis of a frequency band currently being used, such that a state in which the antenna frequency characteristics are optimized also in the multi-frequency environment can always be maintained. The antenna switch can select an optimal pin or plate from the plurality of shorting pins or plates.

As described above, the present invention includes the plurality of shorting pins or plates located at different distances from the feeding pin. Alternatively, the antenna switch may select optimal positions from preset positions and may move shorting plates or pins of the PIFA device to the selected positions. Alternatively, when a single shorting pin or plate is provided in the PIFA device, the single shorting pin or plate may be moved to an optimal position.

Figure 2:
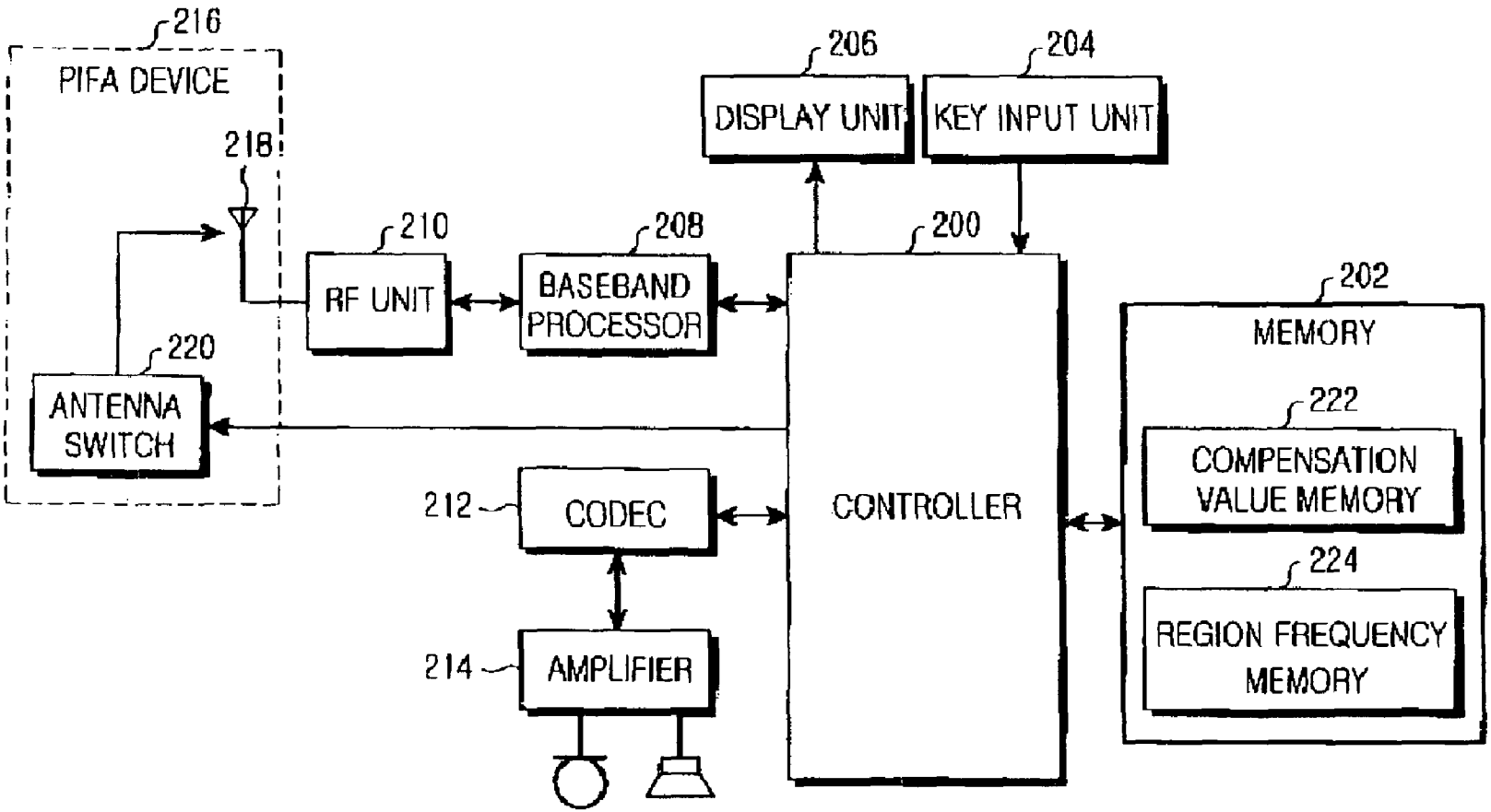
FIG. 2 is a block diagram illustrating a structure of a mobile communication terminal in accordance with an embodiment of the present invention.

FIG. 2 is a block diagram illustrating a structure of a mobile communication terminal in accordance with an embodiment of the present invention. Referring to FIG. 2, the mobile communication terminal includes a memory 202, a key input unit 204, a display unit 206, a baseband processor 208, a coder-decoder (CODEC) 212, an antenna switch 220, and a controller 200. The controller 200 processes voice signals and data according to the protocol for a phone call, data communication or wireless Internet access, and controls the respective components of the mobile communication terminal. Moreover, the controller 200 receives key input from the key input unit 204, and controls the display unit 206 to generate and provide image information in response to the key input. The controller 200 receives current location information from the user or BS. Through the received location information, the controller 200 identifies a frequency band mapped to the current location from a region frequency memory 224 included in the memory 202. The controller 200 determines if a frequency band change is required. When the frequency band change is required, the controller 200 loads from a compensation value memory 222 included in the memory 202 a frequency characteristic compensation value for optimizing the frequency characteristics of an antenna according to a changed frequency band. The controller 200 selects a shorting pin of the PIFA device mapped to the frequency characteristic compensation value for optimizing the antenna frequency characteristics from the compensation value memory 222 or selects a shorting pin position mapped to the frequency characteristic compensation value. The mobile communication terminal can apply the frequency characteristic compensation value for optimizing the antenna frequency characteristics to the PIFA device on the basis of the currently input location information. Here, the shorting pin can be replaced with the shorting plate.

The memory 202 connected to the controller 200 can include a read only memory (ROM), a flash memory, a random access memory (RAM), and so on. The ROM stores a program for processing and control operations of the controller 200 and various types of reference data. The RAM provides a working memory. The flash memory provides an area for storing various types of data capable of being updated. The memory 202 of the mobile communication terminal stores region frequency information for identifying a frequency band to be used at the current location on the basis of currently input location information. For a case where the frequency band change is made as described above, the memory 202 stores information about a shorting pin of the PIFA device mapped to a compensation value for optimizing antenna frequency characteristics or stores information about a shorting pin position mapped to the compensation value. An area in which region frequencies are stored in the memory 202 is referred to as the region frequency memory 224, and an area in which information about compensation values and shorting pins or pin positions mapped thereto are stored is referred to as the compensation value memory 222.

The key input unit 204 includes various types of keys including numeric keys, and provides a key input from a user to the controller 200. A radio frequency (RF) unit 210 transmits an RF signal to and receives an RF signal from the BS. The RF unit 210 converts the received signal into an intermediate frequency (IF) signal and outputs the converted signal to the baseband processor 208 connected to the controller 200. The RF unit 210 converts an IF signal input from the baseband processor 208 into an RF signal and transmits the RF signal. The baseband processor 208 serves as a baseband analog (BBA) application specific integrated circuit (ASIC) for providing an interface between the controller 200 and the RF unit 210. The baseband processor 208 converts a digital baseband signal received from the controller 200 into an analog IF signal and then applies the analog IF signal to the RF unit 210. The baseband processor 208 converts an analog IF signal applied from the RF unit 210 into a digital baseband signal and then applies the digital baseband signal to the controller 200.

The CODEC 212 connected to the controller 200 is coupled to a microphone and a speaker through an amplifier 214. The CODEC 212 performs a pulse code modulation (PCM) encoding operation on a voice signal input from the microphone, and outputs voice data to the controller 200. The CODEC 212 performs a PCM decoding operation on voice data input from the controller 200 and outputs a voice signal to the speaker through the amplifier 214. The amplifier 214 amplifies a voice signal input from the microphone or a voice signal to be output to the speaker, and adjusts the volume of the speaker and the gain of the microphone according to a control operation of the controller 200.

The antenna switch 220 adjusts a shorting pin of a PIFA 218 provided in a PIFA device 216 according to a control operation of the controller 200. The antenna switch 220 selects optimal pins from a plurality of shorting pins provided in the PIFA 218 according to a control operation of the controller 200. In the alternate embodiment, the antenna switch 220 selects an optimal position from preset positions according to a control operation of the controller 200 and moves the shorting pin to the selected position. Accordingly, the PIFA device 216 can maintain optimal antenna characteristics for a changed frequency even when the frequency band is changed.

Figure 3:
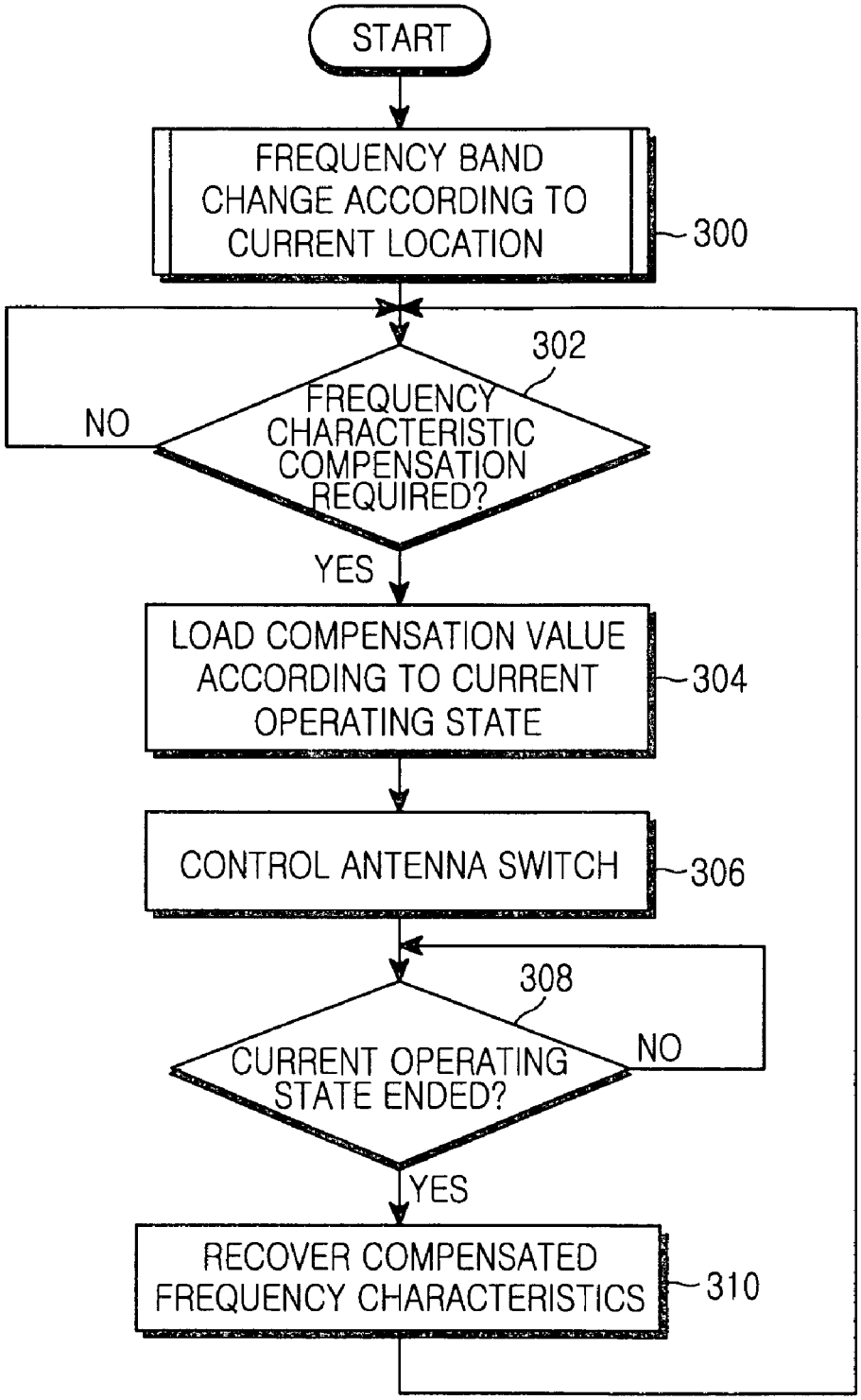
FIG. 3 is a flowchart illustrating an operation for controlling an antenna switch to compensate for frequency characteristics in accordance with an embodiment of the present invention.

FIG. 3 is a flowchart illustrating an operation for controlling the antenna switch 220 in the controller 200 according to a frequency band change. Referring to FIG. 3, the controller 200 of the mobile communication terminal proceeds to step 300 to receive location information from the user or BS and identify the current location. A frequency band change is made according to the identified location.

The controller 200 proceeds to step 302 to determine if the current operating state of the mobile communication terminal requires frequency characteristic compensation. The operating state requiring the frequency characteristic compensation is a specific operating state such as the open or close state of the mobile communication terminal. For example, levels of influencing the antenna frequency characteristics in the folder-type mobile communication terminal may be different between 800-MHz and 450-MHz bands in the open state. If the frequency characteristics of the PIFA are designed to be optimal for the 800-MHz band in the open state, they may not be optimal for the 450-MHz band. That is, if the antenna frequency characteristics are optimized for a frequency band preset for a specific operating state of the mobile communication terminal in an initial design time, they may not be optimal for another frequency band when the preset frequency band is changed to a different frequency band. In this case, the controller 200 determines that the mobile communication terminal is in the operating state requiring the frequency characteristic compensation. This depends upon the changed frequency band based on the location information input in step 300 as described above. The frequency characteristics influenced in each frequency band is based on information stored in the compensation value memory 222 of the memory 202, i.e., information related to frequency characteristic compensation values, as shown in Table 1, that includes frequency simulation results.

TABLE 1

| Frequency Band | Operating State | Compensation Value | Shorting Pin No. |
|---|---|---|---|
| 450 MHz | Close | −5 dB | 6 |
| 800 MHz | Close | 0 dB | 7 |
| 1900 MHz | Close | +15 dB | 8 |

Referring to Table 1, the mobile communication terminal designed to be optimal for the frequency band of 800 MHz requires a compensation value of −5 dB in the frequency band of 450 MHz and a compensation value of −15 dB in the frequency band of 1900 MHz when the user talks over the phone in the close state. The mobile communication terminal selects optimal pins from a plurality of shorting pins provided therein and uses frequency characteristic compensation values. In this case, when the frequency band identified in step 300 is 450 MHz and the user talks over the phone using an earphone in a state in which the mobile communication terminal is closed, the controller 200 determines that the frequency characteristic compensation is required in the current operating state.

When determining that the frequency characteristic compensation is required in the current operating state in step 302, the controller 200 proceeds to step 304 to load from the compensation value memory 222 of the memory 202 a frequency characteristic compensation value for the current operating state. The controller 200 proceeds to step 306 to check information about a shorting pin or its position mapped to the frequency characteristic compensation value loaded in step 304. The controller 200 controls the antenna switch 220 to select a shorting pin mapped to the shorting pin information or controls the antenna switch 220 to move the shorting pin to a position mapped to the shorting pin position information.

Then, the controller 200 proceeds to step 308 to determine if the operating state requiring the frequency characteristic compensation based on the determination in step 302 has ended. If the operating state requiring the frequency characteristic compensation has not ended, the currently selected shorting pin or shorting pin position is continuously maintained. However, if the operating state requiring the frequency characteristic compensation has ended, the controller 200 proceeds to step 310 to control the antenna switch 220 such that a shorting pin or shorting pin position mapped to a changed frequency band is again selected according to the current location in step 300. Then, the controller 200 recovers the frequency characteristics compensated in step 306. The mobile communication terminal can vary a distance between the feeding and shorting pins according to a frequency band, thereby optimizing the frequency characteristics of the PIFA according to each frequency band in the multi-frequency environment. Moreover, even when the frequency band has been changed, the mobile communication terminal can vary the distance between the feeding and shorting pins using a frequency characteristic compensation value according to a specific operating state, thereby optimally maintaining the frequency characteristics of the PIFA also in the specific operating state.

Figure 4:
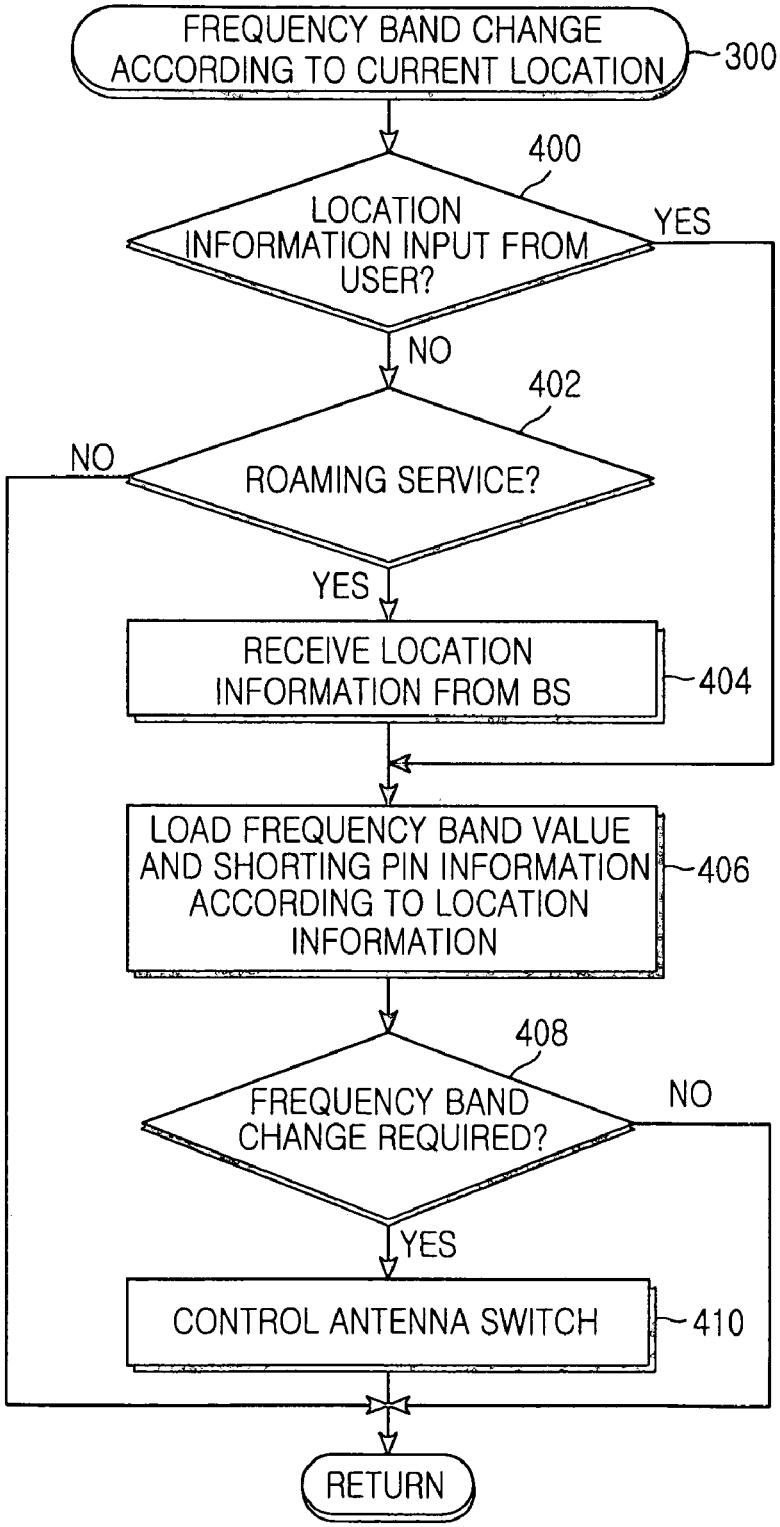
FIG. 4 is a flowchart illustrating an operation for varying frequency characteristics of an antenna on the basis of a frequency band mapped to input location information in accordance with an embodiment of the present invention.

FIG. 4 is a flowchart illustrating an operation for receiving current location information from the user or BS and changing a frequency band based on the location information. Referring to FIG. 4, the controller 200 of the mobile communication terminal proceeds to step 400 to determine if location information has been input from the user. If location information has been input from the user, the controller 200 proceeds to step 406. In step 406, the controller 200 loads information about a frequency band of a region corresponding to the location information input by the user from the region frequency memory 224 of the memory 202 and determines if a frequency band change is required.

However, if location information is absent, the controller 200 proceeds to step 402 to determine if a roaming service is activated. If the roaming service has not been activated, the controller 200 determines that a frequency band change according to the current location is not required. The controller 200 proceeds to step 302 of FIG. 3 to determine if the current operating state of the mobile communication terminal is a state in which the frequency characteristic compensation is required.

However, if the roaming service has been activated as a result of the determination in step 402, the controller 200 proceeds to step 404 to receive location information about the current region from the BS of a cell in which the current roaming service has been activated. Then, the controller 200 proceeds to step 406 to load a frequency band value and shorting pin information mapped to the currently input location information from the region frequency memory 224 of the memory 202. Then, the controller 200 proceeds to step 408 to determine if a frequency band change is required in the mobile communication terminal. Table 2 shows an example of the mobile communication terminal in accordance present invention. Table 2 shows an example in which frequency band values and shorting pin information are stored in the region frequency memory 224.

TABLE 2

| Location Info | Frequency Band | Shorting Pin No. |
|---|---|---|
| South Korea | 800 MHz | 1 |
| Russia | 450 MHz | 2 |
| China | 2100 MHz | 3 |

Referring to Table 2, shorting pins of different positions mapped to frequency bands are set in the mobile communication terminal. Because these shorting pins are present in the different positions, distances between the shorting and feeding pins are different. Because the shorting pins are located at distances from the feeding pin such that the frequency characteristics of the PIFA can be optimal for the frequency band mapped to each shorting pin, the frequency characteristics of the PIFA can be optimal for a frequency of each region in the mobile communication terminal. Preset information indicating shorting pins mapped to frequencies is stored as shown in Table 2. In accordance with the alternate embodiment of the present invention, information about different shorting pin positions is stored in place of the shorting pin numbers.

Then, the controller 200 proceeds to step 410 to control the antenna switch 220 according to the loaded frequency band value and the loaded shorting pin information, such that a position of a shorting pin is adjusted. The mobile communication terminal selects an optimal shorting pin mapped to a frequency band as shown in Table 2. The mobile communication terminal can also select a specific shorting pin position mapped to a frequency band and moves the shorting pin to the selection position. For example, assuming that Table 2 is associated with the PIFA designed to be optimal for frequency characteristics in the open state, the mobile communication terminal uses a shorting pin located at a distance from the feeding pin that can optimize antenna frequency characteristics in the frequency band of 800 MHz in South Korea, such that the frequency characteristics of the PIFA can be optimal for the frequency band of 800 MHz. If the user moves to China, the mobile communication terminal uses a shorting pin located at a distance from the feeding pin that can optimize antenna frequency characteristics in the frequency band of 2100 MHz, such that the frequency characteristics of the PIFA can be optimal for the frequency band of 2100 MHz.

Figure 5A:
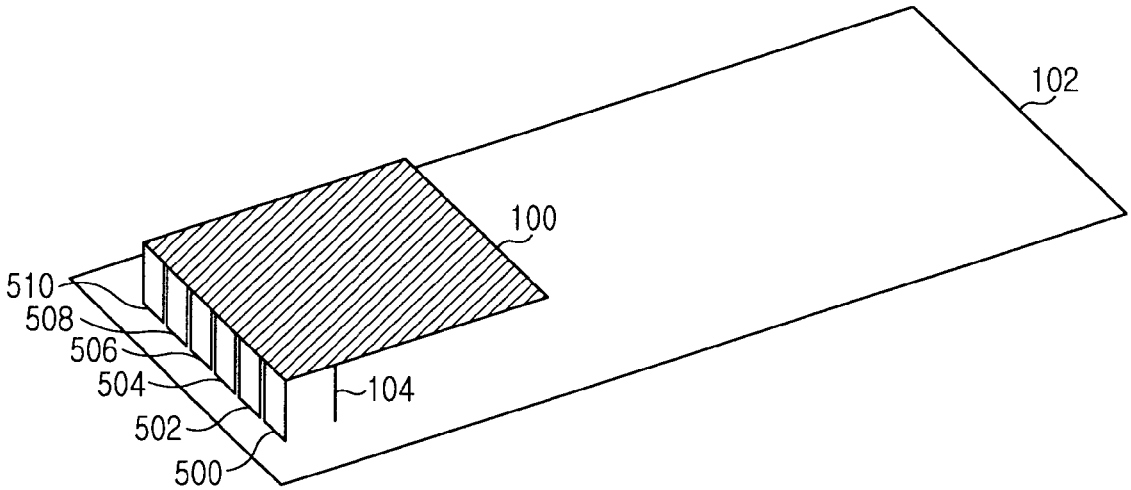
FIGS. 5A, 5B and 5C illustrates an exemplary structure of a PIFA device in accordance with the first embodiment of the present invention.
Figure 5B:
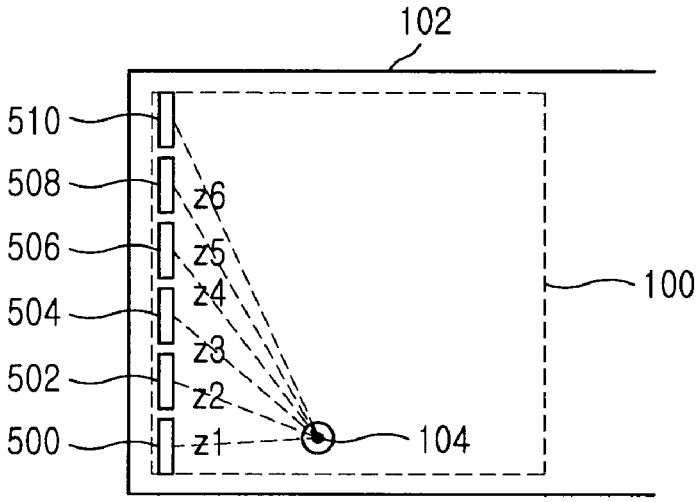
Figure 5C:
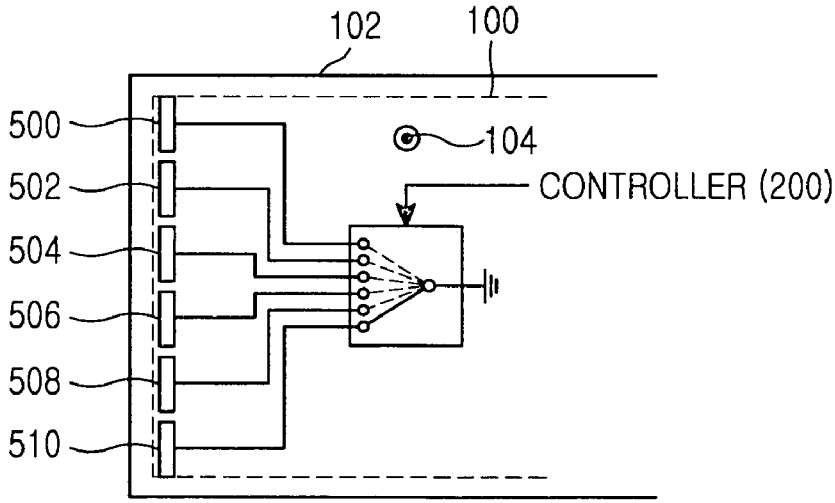

FIGS. 5A, 5B and 5C illustrates an exemplary structure of a PIFA device with a plurality of shorting pins. Referring to FIGS. 5A, 5B, and 5C, the PIFA device is provided with a path 100, a ground plane 102, a feeding pin 104, a plurality of shorting pins 500, 502, 504, 506, 508, and 510, and an antenna switch 220 capable of selecting one of the shorting pins. As illustrated in FIG. 5B, the shorting pins 500, 502, 504, 506, 508, and 510 are located at different distances from the feeding pin 104. Accordingly, the shorting pins provide different antenna frequency characteristics to the PIFA. FIG. 5C illustrates the back of the ground plane 102 of the PIFA. As illustrated in FIG. 5C, the antenna switch 220 selects optimal pins from the shorting pins 500, 502, 504, 506, 508, and 510 according to a control operation of the controller 200. Here, the antenna switch 220 can use a Micro-Electro-Mechanical Systems (MEMS) switch with a low insertion loss and high isolation performance. The mobile communication terminal includes the plurality of shorting pins located at different distances from the feeding pin, such that the PIFA can maintain optimal frequency characteristics also in the multi-frequency environment.

Figure 6A:
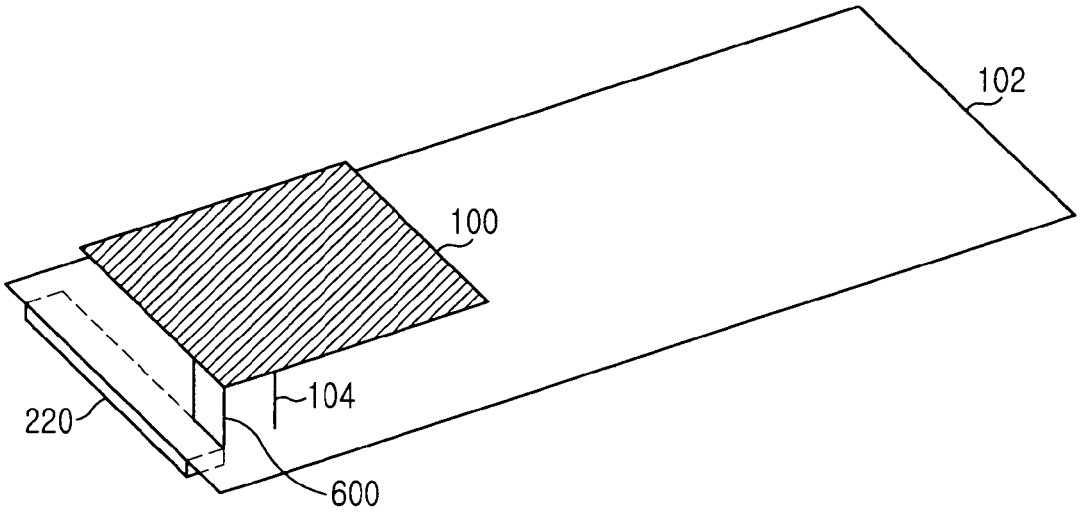
FIGS. 6A and 6B illustrates an exemplary structure of a PIFA device in accordance with the second embodiment of the present invention.
Figure 6B:
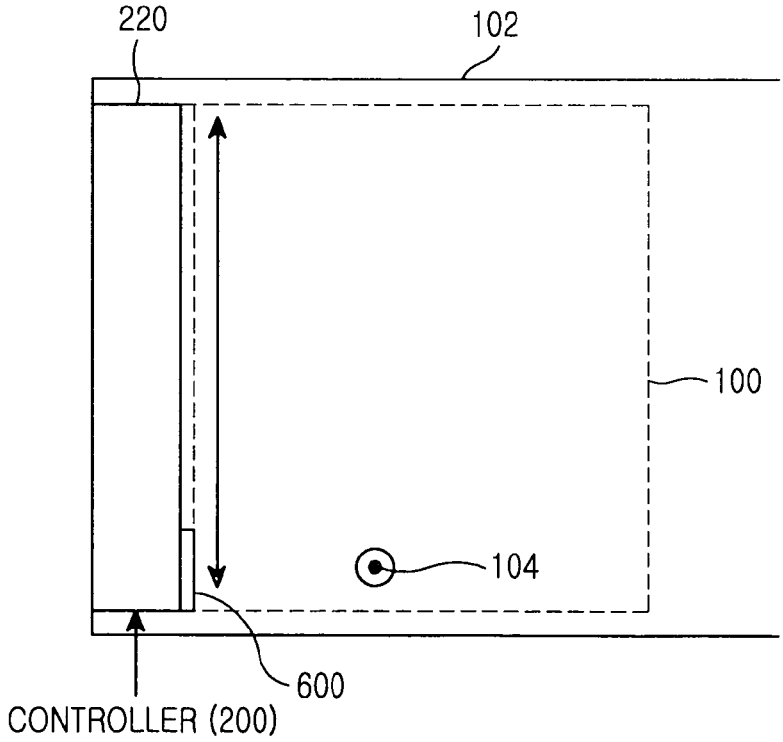

FIGS. 6A and 6B illustrates an exemplary structure of a PIFA device that is provided with an antenna switch 220 capable of moving one shorting pin according to preset location information according to the alternate embodiment. Referring to FIGS. 6A and B, the PIFA device of the mobile communication terminal is provided with the antenna switch 220 capable of moving a shorting pin 600 to an optimal position of shorting pin positions capable of optimizing frequency characteristics on a frequency band-by-frequency band basis. The antenna switch 220 varies a distance between the feeding pin 104 and the shorting pin 600 by moving the shorting pin 600 to a preset position according to a control operation of the controller 200, such that the frequency characteristics of the PIFA are varied. The PIFA device of the mobile communication terminal adjusts the distance between the shorting and feeding pins, thereby optimally maintaining the frequency characteristics between different frequency bands also in the multi-frequency environment.

In accordance with the present invention, the PIFA device is provided with a plurality of shorting pins located at different distances from the feeding pin and an antenna switch capable of selecting one of the shorting pins, or is provided with an antenna switch capable of moving a shorting pin to a preset position, thereby adjusting a distance between the feeding and shorting pins. Because of using a shorting pin located at a distance that can optimize antenna frequency characteristics according to a frequency band used at the current location, the present invention can optimally maintain the antenna frequency characteristics in the multi-frequency environment at any time.

Although preferred embodiments of the present invention have been disclosed for illustrative purposes, those skilled in the art will appreciate that various modifications, additions, and substitutions are possible, without departing from the scope of the present invention. The example in which a distance between a shorting pin and a feeding pin is varied has been described in relation to the embodiments of the present invention. Of course, a shorting plate can be used instead of the shorting pin. The example in which a mobile communication terminal identifies its own location when a roaming service is performed or region information is input from a user has been described in relation to the embodiment of the present invention. Of course, the mobile communication terminal can identify the current location according to location information periodically received from a base station (BS). Therefore, the present invention is not limited to the above-described embodiments, but is defined by the following claims, along with their full scope of equivalents.

What is claimed is:

1. An apparatus for providing optimized frequency characteristics in a multi-frequency environment in a mobile communication terminal, comprising:

a memory for storing frequency characteristic compensation values for optimizing antenna frequency characteristics of the mobile communication terminal on a frequency band basis in the multi-frequency environment;

a Planar Inverted-F Antenna (PIFA) device for varying a distance between feeding and shorting pins; and a controller adjusting the distance between the feeding and shorting pins based on a frequency characteristic compensation value mapped to a frequency band currently being used in the mobile communication terminal, wherein the frequency characteristic compensation values comprise shorting pin position information set according to distances from the feeding pin on a frequency basis such that the PIFA device can provide optimal frequency characteristics.

2. The apparatus of claim 1, wherein the PIFA device comprises:

a plurality of shorting pins located at different positions from the feeding pin; and an antenna switch for selecting optimal pins from the plurality of shorting pins according to a control operation of the controller.

3. The apparatus of claim 2, wherein the frequency characteristic compensation values comprise information indicating optimal pins of the plurality of shorting pins mapped to the frequency characteristic compensation values.

4. The apparatus of claim 2, wherein the controller controls the antenna switch to select an optimal shorting pin from the plurality of shorting pins according to information indicating the plurality of shorting pins.

5. The apparatus of claim 2, wherein the antenna switch is any one of a Micro-Electro-Mechanical Systems (MEMS) switch, a diode switch, and a transistor switch.

6. The apparatus of claim 1, wherein the PIFA device comprises:

a movable shorting pin; and an antenna switch for moving a position of the shorting pin.

7. The apparatus of claim 6, wherein the controller controls the antenna switch to select an optimal pin position from shorting pin position information and move the shorting pin.

8. A method for controlling a Planar Inverted-F Antenna (PIFA) in a mobile communication terminal provided with a PIFA device for varying a distance between feeding and shorting pins, comprising the steps of:

changing a frequency band according to location of the mobile communication terminal;

determining if an operating state of the mobile communication terminal requires frequency characteristic compensation for the PIFA in the changed frequency band;

loading a frequency characteristic compensation value according to a current operating state if the operating state requires the frequency characteristic compensation;

adjusting the distance between the feeding and shorting pins according to the loaded frequency characteristic compensation value;

determining if the operating state of the mobile communication terminal has ended; and recovering compensated frequency characteristics according to the op crating state of the mobile communication terminal if the operating state of the mobile communication terminal has been ended.

9. The method of claim 8, wherein the step of changing the frequency band comprises the steps of:

receiving location information from a user or base station (BS) and identifying a current location;

loading a frequency band value and shorting plate information according to the received location information;

determining if a frequency band change is required using the received location information; and adjusting the distance between the feeding and shorting pins to a shortest distance for a frequency band based on the location information if the frequency band change is required.

10. The method of claim 8, wherein the step of determining the operating state comprises the step of:

determining the operating state using information about frequency characteristic compensation values that are stored in a memory of the mobile communication terminal on a frequency band basis.

11. The method of claim 10, wherein the information about the frequency characteristic compensation values includes compensation value information for optimizing frequency characteristics of the PIFA in a specific frequency band and information about the distance between the feeding and shorting pins mapped thereto in a specific operating state of the mobile communication terminal.

12. The method of claim 8, wherein the PIFA device comprises:

a plurality of shorting pins located at different positions from the feeding pin; and an antenna switch for selecting optimal pins from the plurality of shorting pins according to a control operation of a controller.

13. The method of claim 12, wherein the step of adjusting the distance comprises the step of:

selecting an optimal shorting pin from information about frequency characteristic compensation values.

14. The method of claim 8, wherein the PIFA device comprises:

a movable shorting pin; and an antenna switch for moving a position of the shorting pin.

15. The method of claim 14, wherein the step of adjusting the distance comprises the step of:

moving the shorting pin to a position based on information about a frequency characteristic compensation value.

* * * * *